United States Patent [19]

Trifunovic et al.

[11] 3,978,561

[45] Sept. 7, 1976

[54] APPARATUS FOR TEXTURING CONTINUOUS FILAMENT YARN

[75] Inventors: Alexander L. Trifunovic, Wilmington, Del.; William H. Hills, Melbourne; Milton H. Borgman, Satellite Beach, both of Fla.; Emory P. Mersereau, Wilmington, Del.

[73] Assignee: Indian Head Inc., New York, N.Y.

[22] Filed: Apr. 9, 1975

[21] Appl. No.: 566,206

Related U.S. Application Data

[62] Division of Ser. No. 366,164, June 1, 1973, Pat. No. 3,894,319.

[52] U.S. Cl. ..... 28/1.7

[51] Int. Cl.[2] ..... D02G 1/12

[58] Field of Search ..... 28/1.6, 1.7, 72.14

[56] References Cited

UNITED STATES PATENTS

| | | | |
|---|---|---|---|
| 2,734,229 | 2/1956 | Shattuck | 28/1.7 |
| 3,584,357 | 6/1971 | Torello-Viera | 28/1.7 |
| 3,707,299 | 12/1972 | Trifunovic | 28/1.6 |
| 3,733,659 | 5/1973 | Smith | 28/1.7 |

*Primary Examiner*—Louis K. Rimrodt
*Attorney, Agent, or Firm*—Schuyler, Birch, Swindler, McKie & Beckett

[57] ABSTRACT

A method and apparatus for texturing continuous filament yarn wherein the yarn is fed at a controlled rate and under controlled tension into a confined crimping zone against a mass of crimped yarn therein causing the yarn to collapse longitudinally forming crimps which become part of such mass. Heat and pressure are applied to the yarn mass in the crimping zone to plastically deform the yarn and partially set the crimps. The crimped yarn mass is then fed at a controlled rate from the crimping zone into a setting zone. Heat and pressure are applied to the yarn mass in the setting zone to fully set the crimps. The pressure applied to the yarn mass in the setting zone is substantially only sufficient to keep the crimps closed during the final setting thereof. The crimped yarn mass is then fed from the setting zone into a cooling zone. The yarn mass is cooled in the cooling zone to a temperature below that at which the yarn undergoes any molecular structural alteration in the absence of the application of a substantial force thereto. Finally, the yarn is withdrawn at a controlled rate from the cooling zone in continuous filament form.

10 Claims, 18 Drawing Figures

FIG. 6
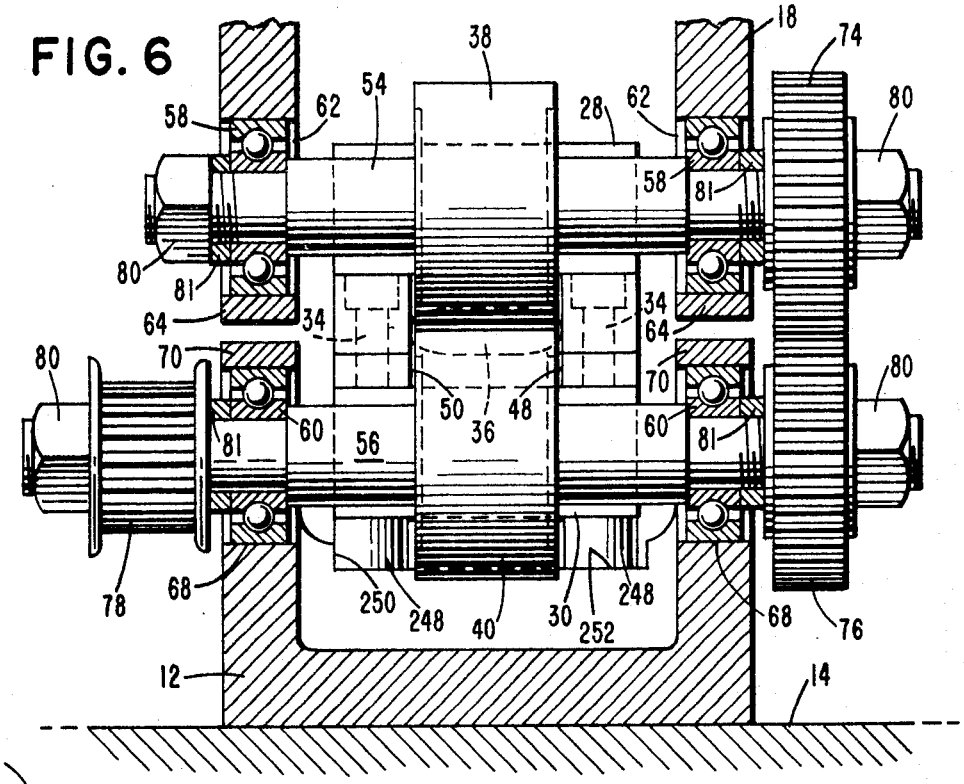
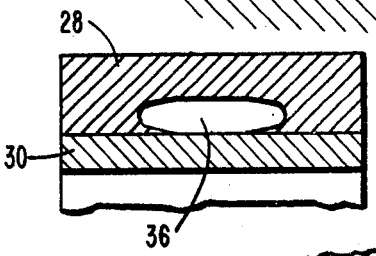
FIG. 6A
FIG. 7
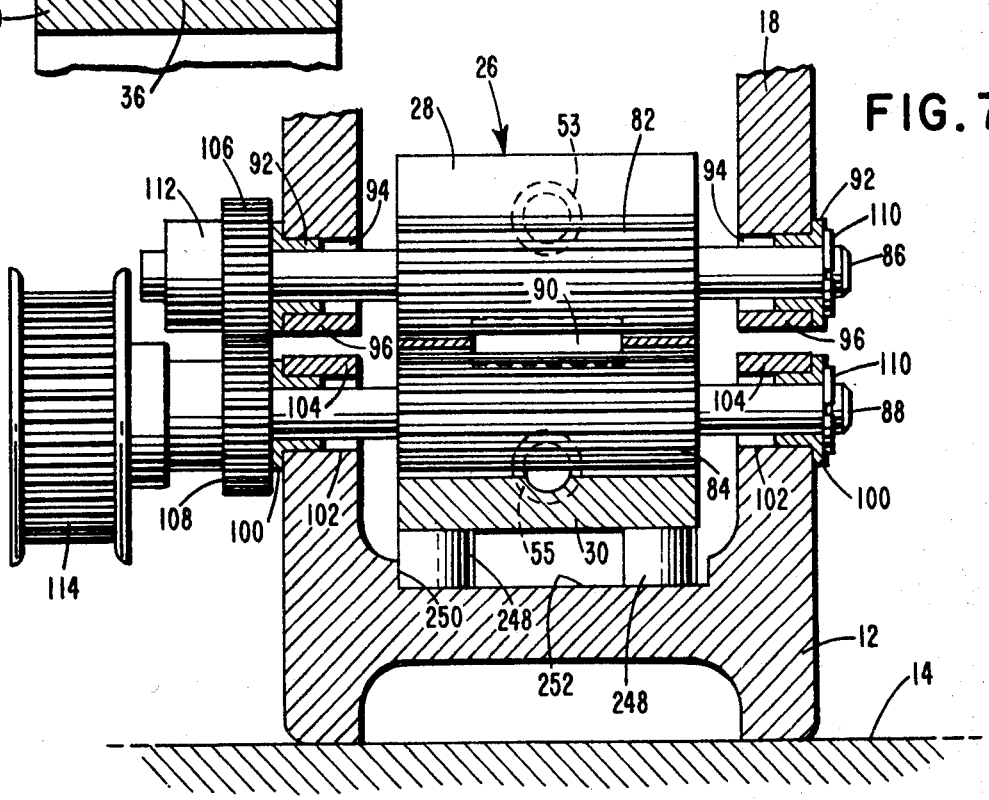

FIG. 10
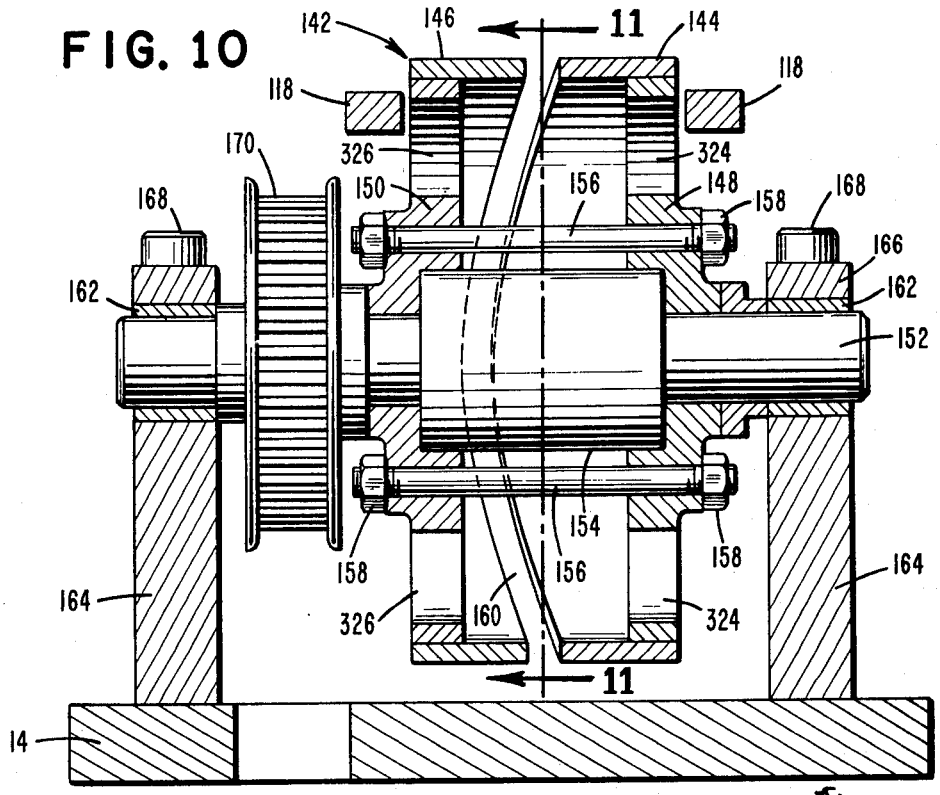
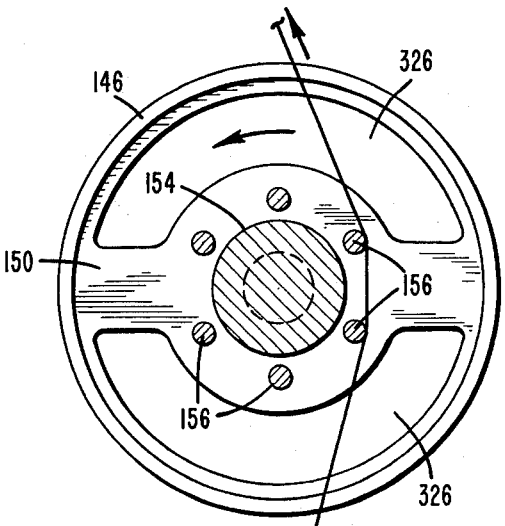
FIG. 11
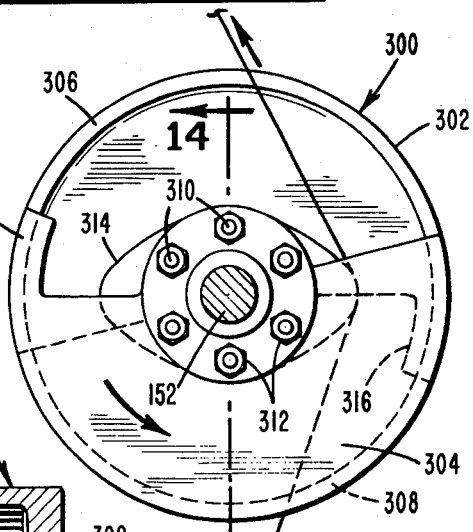
FIG. 13
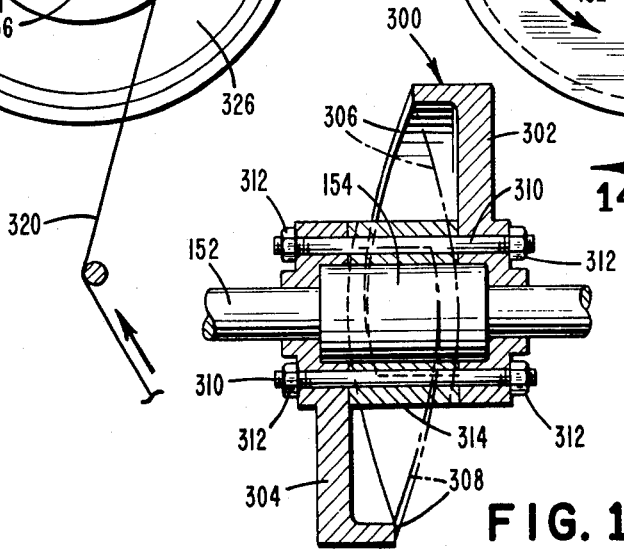
FIG. 14

FIG. 15
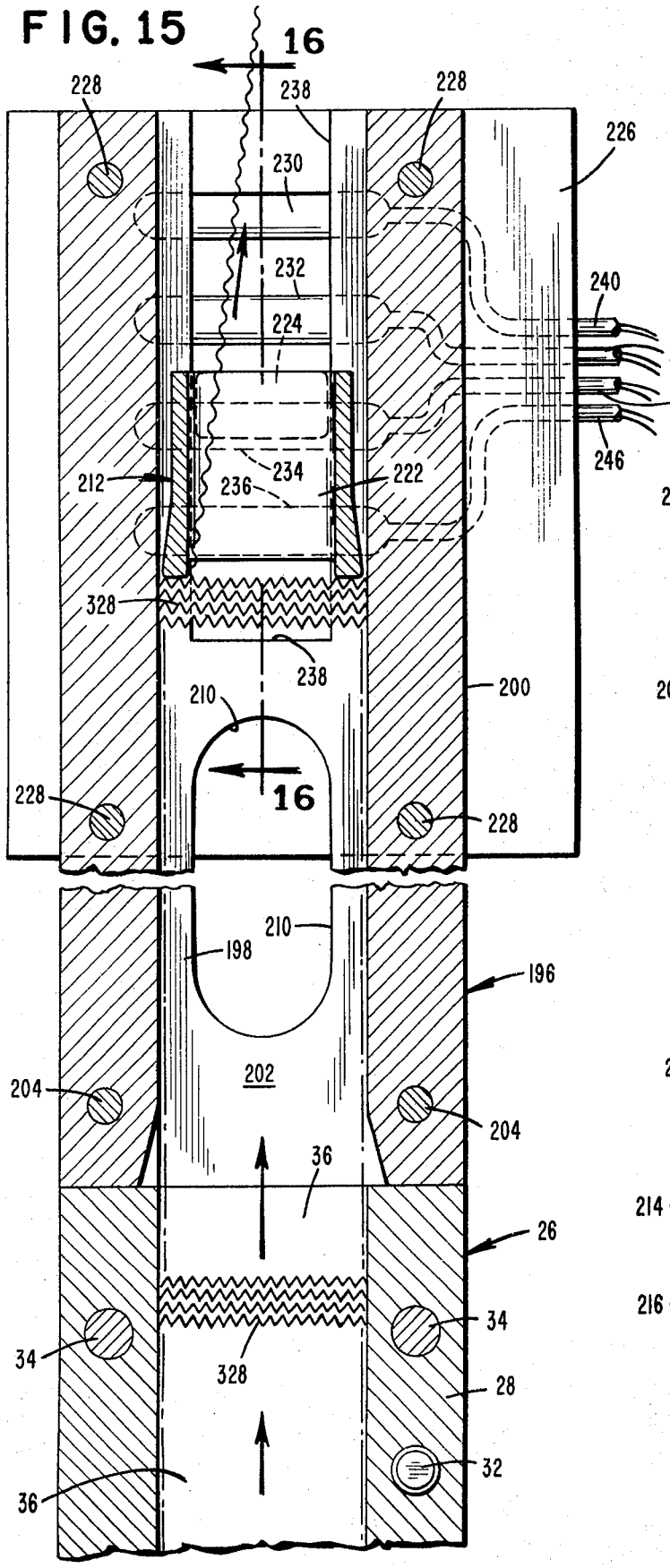
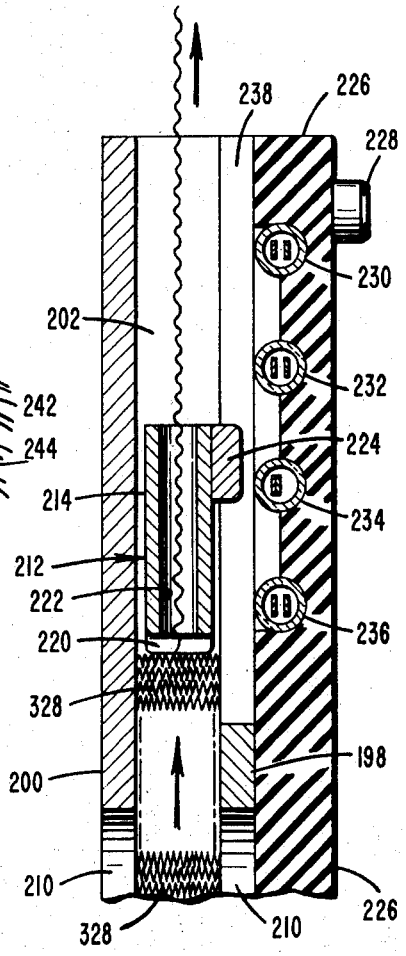
FIG. 16
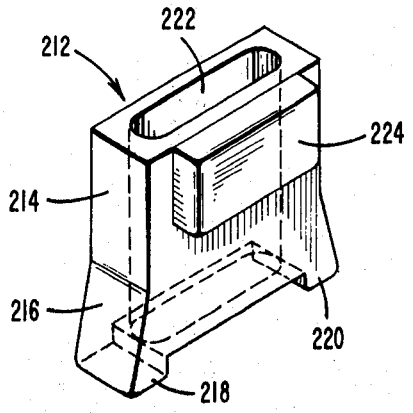
FIG. 17

APPARATUS FOR TEXTURING CONTINUOUS FILAMENT YARN

RELATED APPLICATION

This application is a divisional application of application Ser. No. 366,164, filed June 1, 1973, now U.S. Pat. No. 3,894,319.

BACKGROUND OF THE INVENTION

1. Field of the Invention

The present invention relates to methods and apparatus for texturing continuous filament yarn, and in particular to a method and apparatus which is efficacious for crimping continuous filament polyester yarn.

2. Description of the Prior Art

Several methods of texturing continuous filament polyester yarn presently are known. The methods which have achieved the widest commercial success are those in which the yarn is textured by imparting an artificial or false twist thereto. The quality and uniformity of the textured yarn product produced by such methods vary widely, and production rates are limited to the texturing of approximately 200 yards per minute at each texturing station.

The texturing of continuous filament yarns by imparting longitudinal crimps thereto also has been widely adopted for yarns other than polyester yarn, and particularly for texturing nylon yarn. However, the prior art methods of crimping continuous filament yarns and particularly in a stuffer crimper apparatus largely have been unsuccessful for crimping polyester yarn. This failure results primarily from the different characteristics inherent in nylon and polyester yarns. In the stuffer crimping methods presently used commercially for crimping nylon yarn, a mass of crimped yarn in the form of a crimped yarn core is fed under pressure through a relatively long crimping tube in which significant frictional forces are exerted on the core by the walls of the tube. Nylon yarn, due to its particular characteristics, moves at a substantially uniform rate through the crimping tube, even when subjected to substantial frictional forces. However, polyester yarn, due to its different characteristics, does not move through the crimping tube at a uniform rate but tends to move in spurts, resulting in undesirable variations in the characteristics of the crimped yarn.

SUMMARY OF THE INVENTION

The method and apparatus of the present invention obviate the difficulties associated with use of the prior art stuffer crimper methods and apparatus for crimping polyester yarn, and may be used advantageously for crimping other continuous filament yarns, such as nylon yarn.

Basically described, the method of the invention comprises feeding continuous filament yarn at a controlled rate and under controlled tension into a confined crimping zone against a mass of crimped yarn therein causing the yarn to collapse longitudinally and fold over forming crimps which become part of the mass; applying heat and pressure to the mass in the crimping zone to plastically deform the yarn and partially set the crimps; feeding the mass at a controlled rate from the crimping zone to a setting zone; applying heat and pressure to the mass in the setting zone to fully set the crimps, the pressure applied to the mass in the setting zone being substantially only sufficient to keep the crimps closed during the final setting thereof; feeding the mass from the setting zone to a cooling zone after the crimps have been fully set; cooling the mass in the cooling zone to a temperature below the temperature at which the yarn undergoes any molecular structural alteration in the absence of the application of a substantial force thereto; and withdrawing the yarn at a controlled rate in continuous filament form from the cooling zone.

Basically described, the apparatus of the invention is a stuffer crimper comprising; a housing; a crimping chamber secured to the housing and having a channel extending therethrough; means for heating the chamber; a pair of opposed feed rolls rotatably mounted on the housing adjacent one end of the chamber for feeding yarn into the chamber channel at least one crimp control roll rotatably mounted on the housing and extending into the chamber channel, the portion of the channel between the feed rolls and the crimp control roll defining a confined crimping zone, whereby continuous filament yarn is fed into the crimping zone by the feed rolls against a mass of crimped yarn therein in the form of a core of crimped yarn causing the yarn to collapse longitudinally and fold over forming crimps which become part of the core, the crimp control roll being spaced from the feed rolls along the channel a distance no greater than the distance required for the yarn to be plastically deformed and the crimps partially set in the crimping zone, the portion of the channel between the crimp control roll and the end of the chamber opposite the feed rolls defining a setting zone, whereby the core is fed into the setting zone by the crimp control roll and the crimps are fully set therein, means for rotatably driving the pair of feed rolls at the same rotational velocity; and means for rotatably driving the crimp control roll independently of the feed rolls, whereby the pressure on the crimped yarn core in the crimping zone may be controlled by regulating the relative rotational velocities of the feed rolls and the crimp control roll.

Generally, the leg length of the crimps and therefore the bulk of the crimped yarn are controlled by regulating the pressure applied to the crimped yarn core in the crimping zone, although other parameters, such as heat and time of residence in the crimping zone, also affect the characteristics of the crimped yarn.

The pressure applied to the crimped yarn core is a function of the relative rotational velocities of the feed rolls and the crimp control roll. Moreover, it has been found that such pressure also is a function of the rate at which the crimped yarn core moves through the crimping zone. Generally, as the rate at which the core moves through the crimping zone is increased for a particular ratio of feed roll velocity to crimp control roll velocity, the pressure applied to the core decreases and therefore the bulk of the crimped yarn also decreases.

In both the crimping and setting zones, the crimped yarn core is heated to a temperature below the liquefaction temperature of the yarn. The time of residence of the core in the crimping zone is substantially less than the time of residence of the core in the setting and cooling zones, and in the latter two zones the frictional forces applied to the core are minimized.

In the preferred embodiment of the apparatus of the invention, the channel in the crimping chamber has a substantially rectangular transverse cross-section. Desirably, the cross-sectional width of the channel should be as small as possible, and ideally approximately equal to the diameter of the yarn. However, both structural and operational factors limit the minimum cross-sectional width of the channel. For example, for wearing apparel yarn, i.e. 40–150 denier, the cross-sectional width of the channel must be at least approximately 0.10 inch.

The preferred embodiment of the apparatus also includes means for feeding yarn into the nip between the feed rolls with a traversing motion axially of the feed rolls under controlled tension, and means for controlling the relative feed and withdrawal rates of yarn into and from the crimper.

Also, in the preferred embodiment of the apparatus, a relatively short portion of the channel in the crimping chamber adjacent the feed rolls has a substantially elliptical transverse cross-section. This feature in combination with the traversing yarn feed to the feed rolls results in the formation of a uniformily crimped yarn core in the crimping zone.

The preferred embodiment of the apparatus further includes a slug which rides freely on the top of yarn core in the cooling zone. The slug has a channel therethrough through which the yarn is withdrawn in continuous filament form from the cooling zone. The slug also has a particular external configuration which facilitates withdrawal of the yarn in a substantially slub-free condition.

With the foregoing in mind, it is an object of the present invention to provide an improved method and apparatus for texturing continuous filament yarn, and particularly polyester yarn.

It is a further object of the invention to provide an improved method and apparatus for texturing continuous filament yarn by crimping such yarn.

It is also an object of the invention to provide an improved method and apparatus for crimping continuous filament yarn which achieve a high degree of crimp uniformity and which are operable at yarn feed speeds of approximately 1,000 yards per minuts per crimping station.

It is an additional object of the invention to provide a method and apparatus for crimping continuous filament yarn in which a high degree of control may be exercised over the bulk of the crimped yarn product produced.

These and other objects of the invention will become apparent upon a consideration of the detailed description of the preferred embodiment of the method and apparatus thereof given in connection with the following drawings, wherein like reference numerals identify like elements throughout.

BRIEF DESCRIPTION OF THE DRAWINGS

FIG. 6 is a sectional view taken on line 6—6 of FIG. 3;

FIG. 6A is a sectional view taken on line 6A—6A of FIG. 3;

FIG. 7 is a sectional view taken on line 7—7 of FIG. 3;

FIG. 10 is a sectional view taken on line 10—10 of FIG. 2;

FIG. 11 is a sectional view taken on line 11—11 of FIG. 10;

FIG. 13 is a side elevational view of a second embodiment of a yarn feeding means which may be employed in the apparatus shown in FIG. 1;

FIG. 14 is a sectional view taken on line 14—14 of FIG. 13;

FIG. 15 is a sectional view taken on line 15—15 of FIG. 1;

FIG. 16 is a sectional view taken on line 16—16 of FIG. 15;

FIG. 17 is a perspective view of the slug employed in the apparatus shown in FIG. 1.

DESCRIPTION OF THE PREFERRED EMBODIMENTS

Figures 1, 1A:
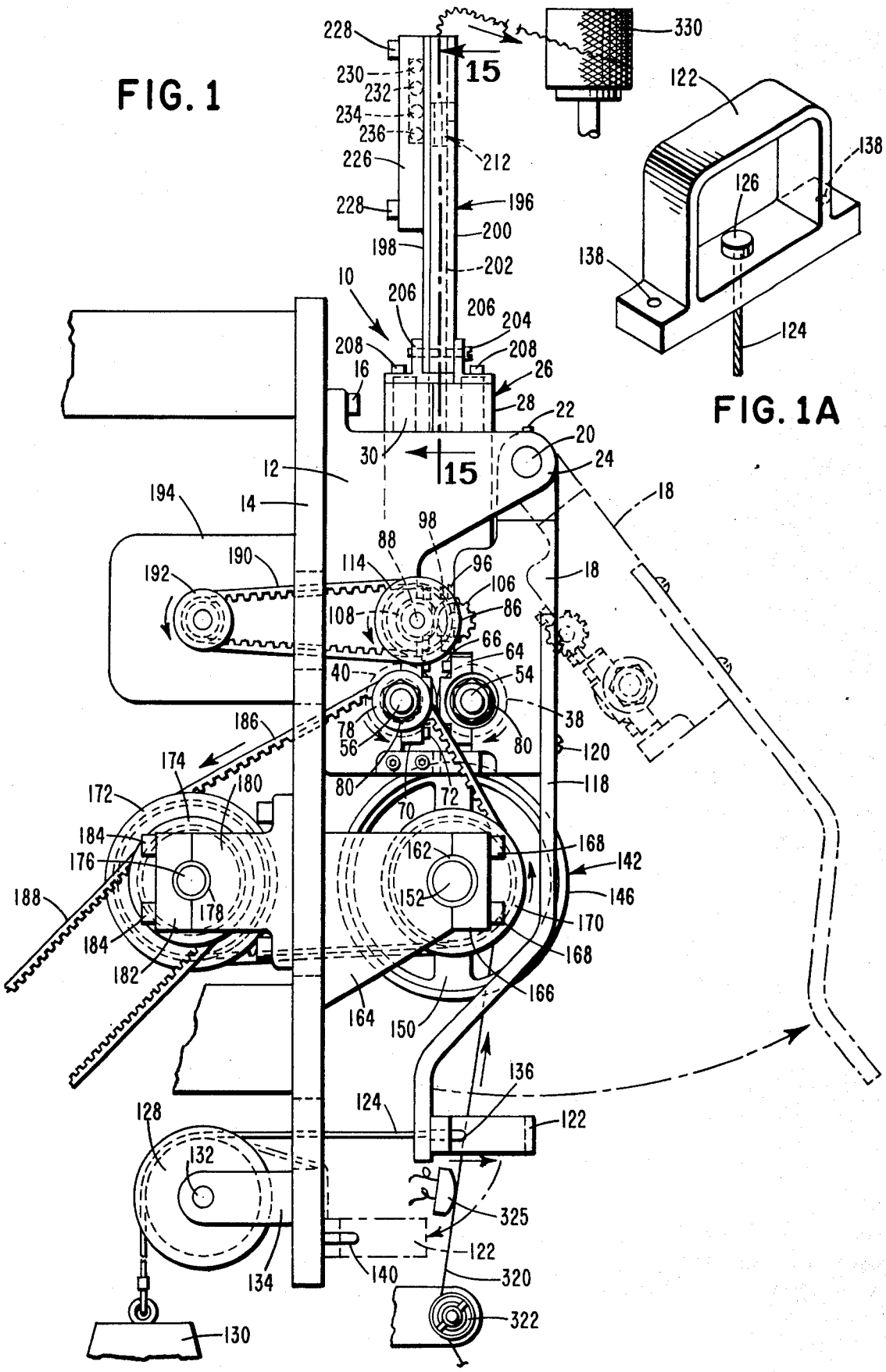
FIG. 1 is a side elevational view of a preferred embodiment of the stuffer crimper apparatus of the invention.
FIG. 1A is a perspective view of a detail of the apparatus shown in FIG. 1.

A preferred embodiment of the apparatus of the invention is a stuffer crimper designated generally by reference numeral 10. Crimper 10 includes a rear stationary housing member 12 (FIGS. 1 and 3) which is secured to a frame 14 by bolts 16, or other suitable fasteners. A front housing member 18 is pivotally connected to rear housing member 12 by a shaft 20. Shaft 20 is secured to front housing member 18 by set screws 22 and is journalled for rotation in a pair of extensions 24 forming the front upper portion of rear housing member 12.

Figure 3:
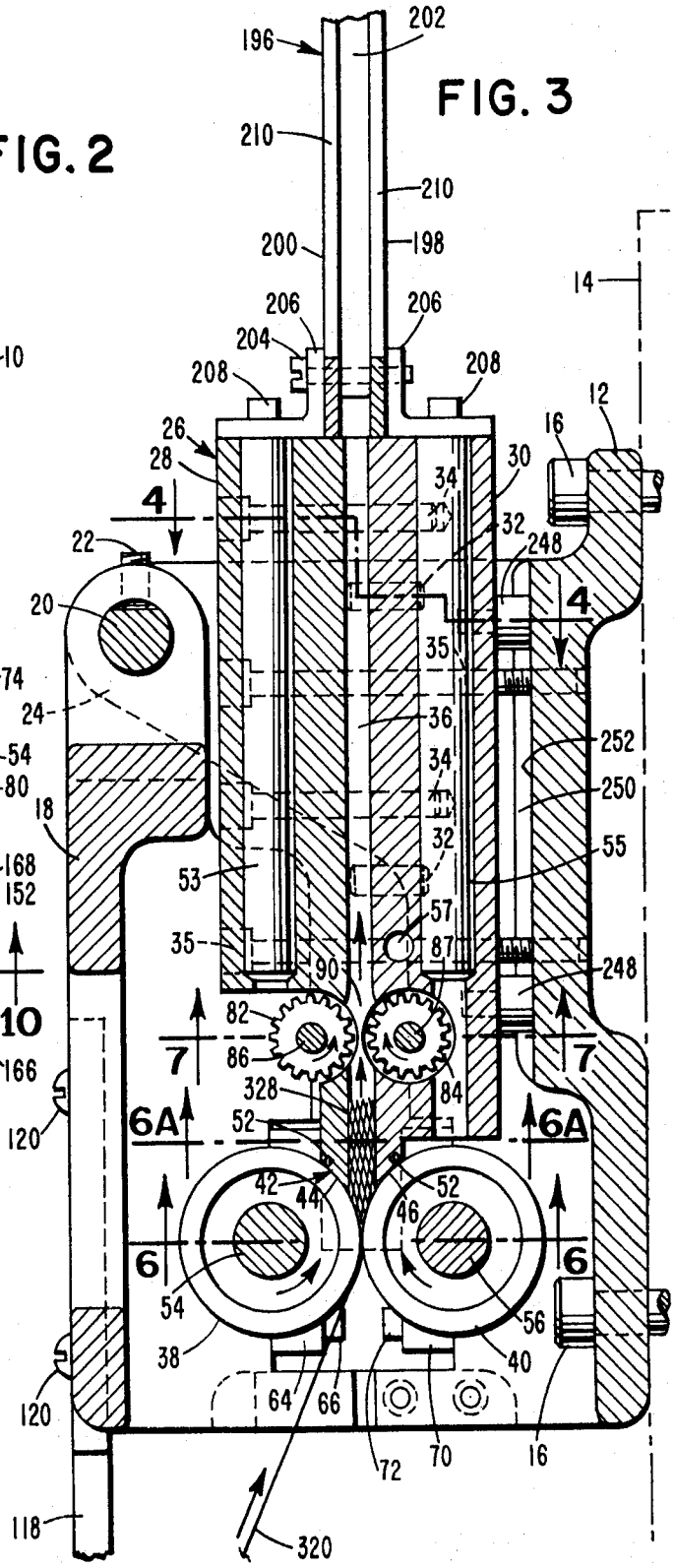
FIG. 3 is a longitudinal sectional view of the apparatus shown in FIG. 1.
Figure 9:
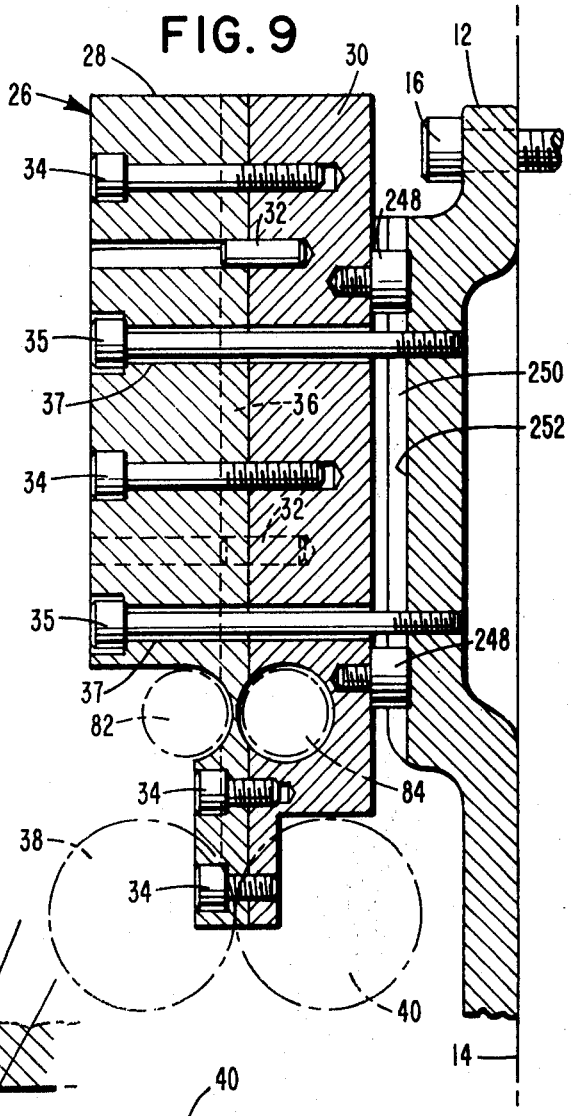
FIG. 9 is a sectional view taken on line 9—9 of FIG. 8.

Mounted between housing members 12 and 18 is a crimping member 26 comprising front and rear longitudinally mated halves 28 and 30, respectively (FIGS. 3 and 9). Chamber halves 28 and 30 are made from a metallic material having relatively high heat conductivity, such as an alloy of aluminum, and are secured together by a plurality of friction fitted pins 32 and bolts 34. Assembled chamber 26 is secured to rear housing member 12 by a plurality of bolts 35, or other suitable fasteners. Bolts 35 are inserted through openings 37 in chamber halves 28 and 30 (FIG. 9) which have a slightly larger diameter than the bolts for a purpose described hereinbelow. Chamber halves 28 and 30 define therebetween an elongated channel 36 which extends completely through the chamber. A short portion of channel 36 at the lower end thereof has a generally elliptical transverse cross-section (FIG. 6A) and the remaining portion of the channel has a substantially rectangular transverse cross-section.

A pair of opposed feed rolls 38 and 40 are journalled in housing member 18 and 12, respectively, adjacent the lower end of chamber 26 and define a nip therebetween. The lower end of the chamber defines a saddle 42 which fits closely about the peripheries of the feed rolls from slightly below to above the nip therebetween (FIG. 3). Saddle 42 includes a pair of arcuate surfaces 44 and 46 machined on chamber halves 28 and 30, respectively, which fit closely about the circumferential peripheries of rolls 38 and 40, respectively. Also, saddle 42 includes opposed end surfaces 48 and 50 (FIGS. 3, 5, 6 and 8) machined on chamber halves 28 and 30 which fit closely about the axial peripheries of rolls 38 and 40. A felt pad 52 (FIG. 3) is mounted at the upper end of each of arcuate surfaces 44 and 46 and extends outwardly from the associated surface into contacting engagement with the associated rolls 38 and 40.

A pair of elongated electrical heating elements 53 and 55 (FIGS. 3, 4 and 7) are inserted in the upper portions of chamber halves 28 and 30, respectively, and extend parallel to channel 36. Another electrical heating element 57 may be inserted in the lower portion of chamber half 30 and extends transversely of channel 36.

Rolls 38 and 40 are machined as integral portions of shafts 54 and 56, respectively, (FIGS. 3 and 6). Shaft 54 is journalled in bearings 58 mounted in front housing member 18, and shaft 56 is journalled in bearings 60 mounted in rear housing member 12. The outer races on bearings 58 are accommodated in recesses 62 machined in front housing member 18 and are locked in position therein by bearing retainers 64. Retainers 64 are secured to housing member 18 by bolts 66 (FIG. 1). Similarly, the outer races of bearings 60 are accommodated in recesses 68 formed in rear housing member 12 and are locked in position therein by bearing retainers 70. Retainers 70 are secured to housing member 12 by bolts 72 (FIG. 1).

A gear 74 is affixed to one end of shaft 54 and a similar gear 76 is affixed to the same end of shaft 56. Also, a pulley 78 is affixed to the end of shaft 56 opposite gear 76. The ends of shafts 54 and 56 are threaded and the shafts are axially locked in position with respect to bearings 58 and 60 by nuts 80 and spacers 81 (FIG. 6).

A pair of opposed crimp control rolls 82 and 84 also are journalled in housing members 18 and 12, respectively, about axes parallel to the axes of feed rolls 38 and 40. In the preferred embodiment of the apparatus of the invention, the crimp control rolls have textured surfaces formed by gear-like teeth and are machined as integral portions of shafts 86 and 88, respectively, (FIGS. 3 and 7). Rolls 82 and 84 are accommodated within arcuate openings machined in chamber halves 28 and 30, respectively, with the peripheries of the rolls being spaced apart within channel 36, as shown by reference numeral 90. Shaft 86 is journalled in bushings 92 which are accommodated in recesses 94 machined in front housing member 18. Bushings 92 are locked in position by retainers 96 which are secured to housing member 18 by bolts 98 (FIG. 1). Similarly, shaft 88 is journalled in bushings 100 which are accommodated in recess 102 machined in rear housing member 12. Bushings 100 are locked in position by retainers 104 which are secured to housing member 12 by suitable bolts (not shown).

A gear 106 (FIG. 7) is affixed to one end of shaft 86 and a similar gear 108 is affixed to the same end of the shaft 88. Also, a pulley 114 is affixed to the same end of shaft 88 as gear 108, outwardly of the gear. Shafts 86 and 88 are axially locked in position with respect to bushings 92 and 100 by spring clips 110 and clamps 112.

When front housing member 18 is pivoted rearwardly about the axis of shaft 20 to the position shown in solid lines in FIG. 1, gear 74 meshes with gear 76 and gear 106 meshes with gear 108. Also, the circumferential periphery of feed roll 38 contacts the circumferential periphery of feed roll 40 forming a nip therebetween. The teeth of gears 74, 76, 106 and 108 are elongated sufficiently to insure that the gears will mesh properly when the feed rolls are in contact with each other.

Crimper 10 also includes means for urging front housing member 18 rearward toward rear housing member 12. Such means include a split frame 118 which is affixed to front housing member 18 by bolts 120, or other suitable fasteners. Frame 118 extends downwardly and inwardly from the lower end of housing member 18 (FIGS. 1 and 2), and a handle 122 is removably connected to the lower end thereof.

A flexible cable 124 extends through the back of handle 122 and is slidably connected thereto by a disc 126 affixed to the end of the cable (FIG. 1A). Cable 124 passes around a pulley 128, and a weight 130 is affixed to the other end thereof. Pulley 128 is mounted on a shaft 132 which is journalled in a pair of arms 134 affixed to frame 14.

Affixed to the lower end of frame 118 are a pair of horizontally aligned pins 136 which are adapted to register with and engage a pair of openings 138 in the back of handle 122. As will be apparent, when pins 136 are engaged with openings 138, weight 130, via cable 124, urges frame 118 and front housing member 18 rearwardly toward rear housing member 12, thus insuring that the circumferential periphery of feed roll 38 contacts the circumferential periphery of feed roll 40.

When it is desired to pivot front housing member 18 away from rear housing member 12, as shown in phantom lines in FIG. 1, handle 122 is pulled outwardly so that pins 136 disengage openings 138, thus releasing frame 118. For convenience, a pair of pins 140 similar to pins 136 are affixed to frame 14 and are adapted to register with and engage openings 138 to hold handle 122 against the frame in the position shown in phantom lines in FIG. 1 when housing member 18 is pivoted away from housing member 12.

Figure 12:
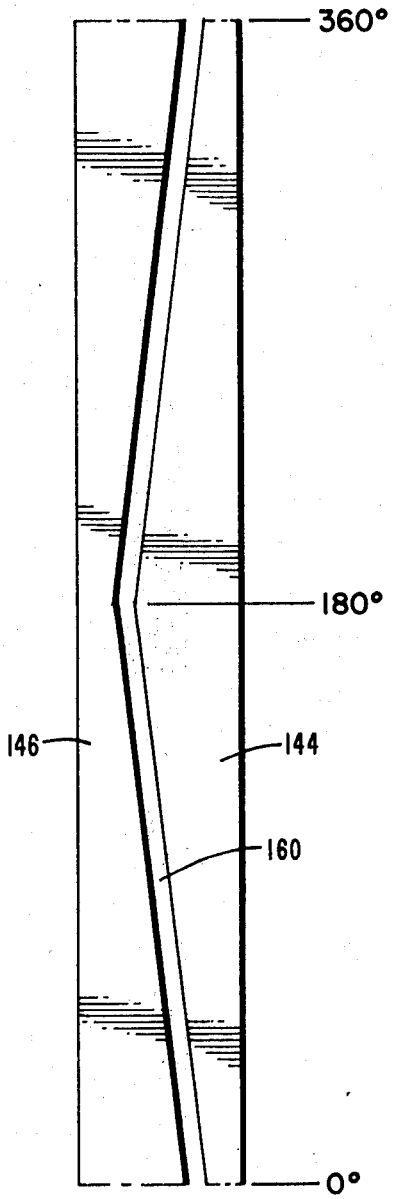
FIG. 12 is a layout view of the surface of the cam of the yarn feeding means shown in FIG. 10.
Figure 8:
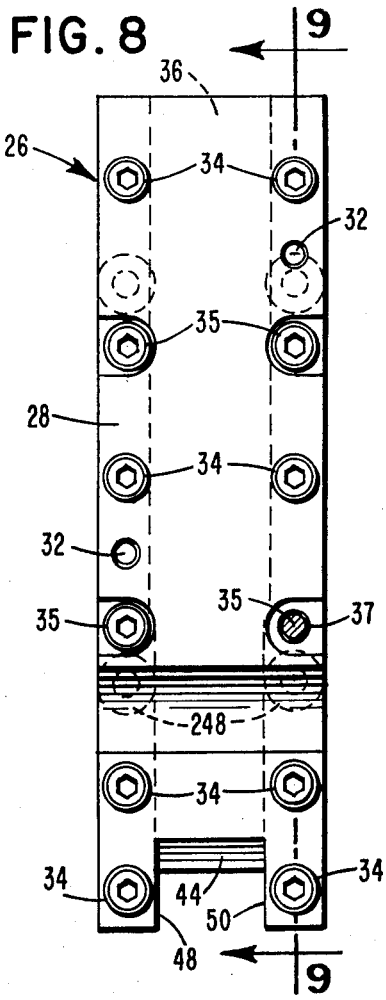
FIG. 8 is a front elevational view of the crimping chamber of the apparatus shown in FIG. 1.

Crimper 10 further includes means mounted below feed rolls 38 and 40 for feeding yarn to the nip between the feed rolls. The yarn feeding means includes a split cam 142 (FIG. 10 and 11). Cam 142 comprises a pair of axially opposed, cylindrical yarn guiding members 144 and 146 which are affixed, respectively, to a pair of circular flanges 148 and 150. Flanges 148 and 150 are mounted on a shaft 152 having an enlarged cylindrical central portion 154. Flanges 148 and 150 accommodate the ends of enlarged shaft portion 154, and are connected together by a plurality of circumferentially spaced rods 156. The ends of rods 156 are threaded and receive nuts 158 thereon which lock flanges 148 and 150 onto shaft 152. Guiding members 144 and 146 define a helical slot 160 (FIG. 12) therebetween through which yarn is fed to feed rolls 38 and 40 as described hereinbelow.

Shaft 152 is journalled about an axis parallel to the axes of feed rolls 38 and 40 in bushings 162 which are accommodated in a pair of arms 164 affixed to frame 14. Bushings 162 are locked in position by retainers 166 which are secured to arms 164 by bolts 168 (FIGS. 1 and 10). Also mounted on shaft 152 and interposed between flange 150 and the adjacent bushing 162 is a pulley 170.

A pair of pulleys 172 and 174 (FIG. 1) are mounted on a shaft 176 which is journalled about an axis parallel to the axes of feed rolls 38 and 40 in bushings 178.

Bushings 178 are accommodated in a pair of arms 180 affixed to frame 14, and are locked in position by retainers 182 which are secured to arms 180 by bolts 184.

A belt 186 is trained about pulleys 78, 170 and 172 so that feed rolls 38 and 40 are driven in synchronism with cam 142. A belt 188 is trained about pulley 174 and a pulley (not shown) connected to an appropriate driving means (not shown), such as an electric motor, for driving feed rolls 38 and 40 and cam 142.

A belt 190 is trained about pulley 114 and a pulley 192 affixed to the output shaft of a transmission 194. An electric motor (not shown) is drivingly connected to transmission 194 for rotating crimp control rolls 82 and 84.

Appropriate openings are formed in frame 14 to permit the passage of cable 124, and belts 186 and 190 therethrough.

Crimper 10 further includes a cooling tower 196 (FIGS. 1, 2, 15 and 16) affixed to the upper end of crimping chamber 26. Tower 196 comprises a pair of longitudinally mated halves 198 and 200 which define a channel 202 therebetween. Channel 202 is vertically aligned with channel 36 in chamber 26. Members 198 and 200 are connected together at the lower ends thereof and to right-angle flanges 206 by bolts 204. Flanges 206 are secured to the upper end of chamber 26 by bolts 208. A longitudinally extending transverse opening 210 is formed in the side of each of members 198 and 200 to permit a coolant, such as compressed air, to be circulated into and through tower 196.

A slug 212 rides freely in the upper end of channel 202 on the top of a core of crimped yarn therein. The formation of the core and the movement thereof through crimper 10 are described hereinbelow. Slug 212 (FIG. 17) has an upper parallelepiped shaped portion 214 and a lower generally pyramidal shaped portion 216. Lower portion 216 includes a pair of leg-like members 218 and 220 which extend downwardly and outwardly at opposite sides thereof. Members 218 and 220 extend downwardly slightly below the central section of the lower end of lower portion 216. A channel 222 having an elliptically shaped transverse cross-section extends longitudinally through slug 212. Also, a small permanent magnet 224 is attached to one side of upper portion 214 for a purpose described hereinbelow.

A case 226 is mounted on the side of member 198 adjacent the upper end thereof. A plurality of bolts 228 extend through case 226 and member 198 and are threadably received by member 200, and thereby secure the case to member 198 and connect members 198 and 200 together at the upper ends thereof. Mounted within case 226 are four vertically spaced, magnetically sensitive reed switches 230, 232, 234 and 236.

Member 198 has a longitudinally extending transverse opening 238 therein adjacent switches 230, 232, 234 and 236. As slug 212 moves vertically upwardly and downwardly with the upper end of the core of crimped yarn, magnet 224 moves into and out of proximity with switches 230, 232, 234 and 236, and selectively closes and opens the switches. Electrical leads 240, 242, 244 and 246 connect switches 230, 232, 234 and 236, respectively, to various electrical circuits to control the operation of crimper 10 as described hereinbelow.

Figure 4:
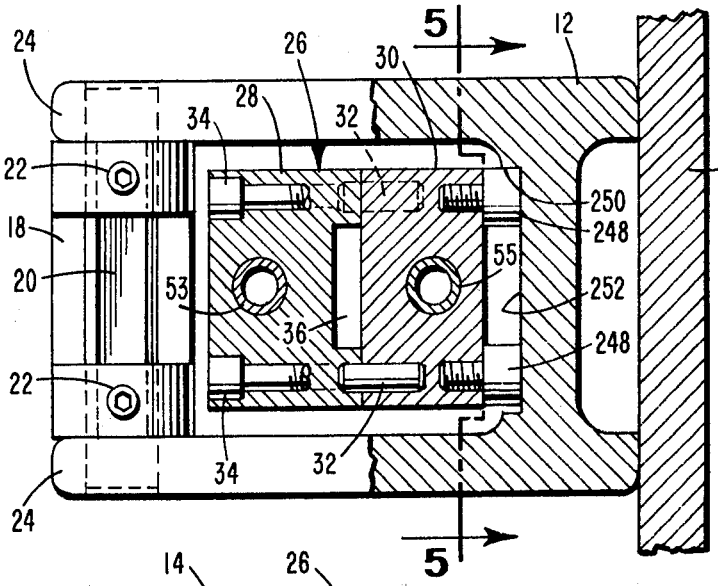
FIG. 4 is a sectional view taken on line 4—4 of FIG. 3.
Figure 5:
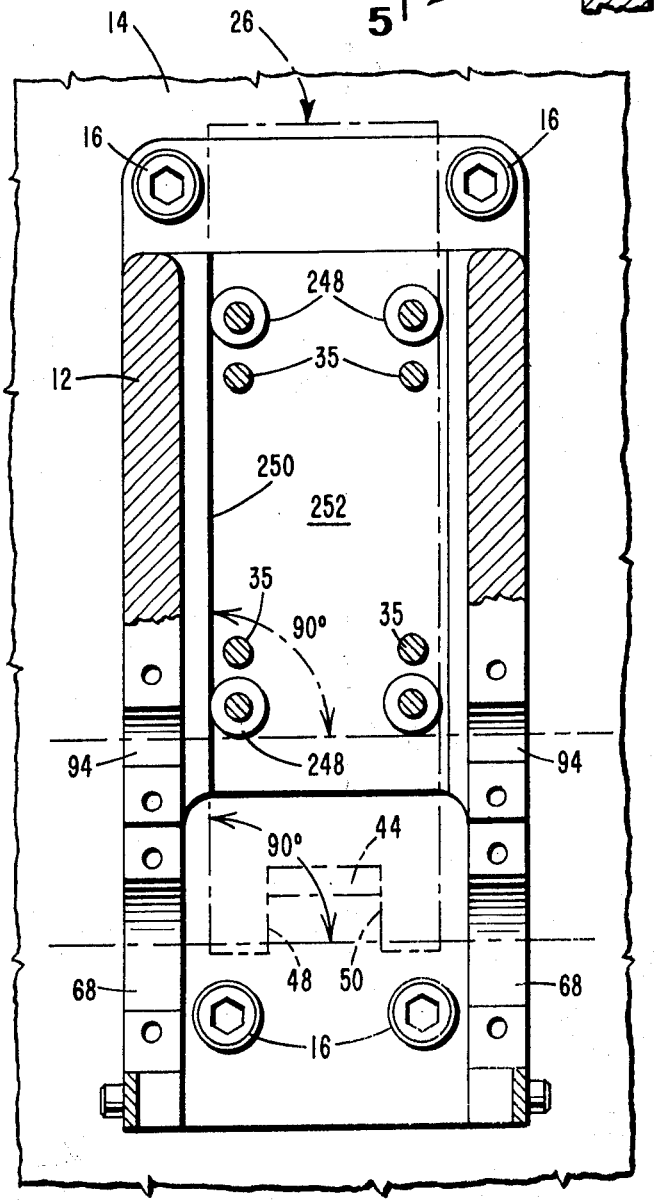
FIG. 5 is a sectional view taken on line 5—5 of FIG. 4.

Crimper 10 is constructed in such a manner as to facilitate the proper alignment of feed roll 38 and 40 with each other and with saddle 42. During the manufacture of the crimper, channel 36 is machined in chamber half 28 (FIG. 4), and chamber halves 28 and 30 are then connected together by pins 32 and bolts 34. Saddle 42 is then machined at the lower end of assembled chamber 26. A plurality of members, such as studs 248, are inserted in the rear side of chamber 26 and project outwardly therefrom. At least two of studs 248 on the left side of the chamber as seen in FIG. 5, define a line parallel to channel 36. The diameter of the studs is accurately controlled and the ends thereof are machined so that the distance between such ends and the rear wall of channel 36 is constant.

The inner surfaces of rear housing member 12 include vertical machined surfaces 250 and 252. Surfaces 250 and 252 are perpendicular to each other and define a pair of reference planes which contact studs 248 to properly position chamber 26 transversely (side-to-side) and laterally (front-to-rear) with respect to rear housing member 12. As shown in FIGS. 4 and 5 this result is achieved by placing the two studs 248 on the left side of chamber 26 as seen in FIG. 5 against surface 250 and the ends of the studs against surface 252.

The distance between surface 252 and the journals for shaft 20 in extensions 24 of rear housing member 12 also is carefully determined so that shaft 20 is accurately positioned with respect to reference surface 252. In this manner, front housing member 18 is accurately positioned with respect to rear housing member 12.

Also, bearing recesses 62 and 68 and bushing recesses 94 and 102 are accurately machined with respect to the position of shaft 20. In this manner, feed rolls 38 and 40 and crimp control rolls 82 and 84 are accurately positioned with respect to each other.

During assembly of crimper 10, chamber 26 is first connected to rear housing member 12 by bolts 35 which initially are not securely tightened. Front housing member 18 is then connected to rear housing member 12 by shaft 20. Bearings 58 and 60 and bushings 92 and 100 are then mounted in recesses 62, 68, 94 and 102, respectively. Feed rolls 38 and 40 and crimp control rolls 82 and 84 are then adjusted axially with respect to saddle 42, and retainers 64 and 70, and 96 and 104 are secured to the respective housing members to lock the feed rolls and crimp control rolls in position. Finally, chamber 26 is adjusted longitudinally (vertically) with respect to feed rolls 38 and 40 to provide the proper clearance between the feed rolls and saddle 42, and bolts 35 are tightened to secure chamber 26 to rear housing member 12.

A second embodiment of a yarn feeding means which may be employed with crimper 10 is shown in FIGS. 13 and 14 and comprises a split cam 300. Cam 300 includes a pair of axially and circumferentially opposed, generally semi-circular guiding members 302 and 304. Member 302 defines a helical yarn guiding surface 306, and member 304 defines a similar guiding surface 308 which is axially and circumferentially opposed to surface 306. Members 302 and 304 are affixed to shaft 152 by a plurality of threaded rods 310 and nuts 312. Axially interposed between members 302 and 304 is a generally elliptically shaped cam 314 which is secured about enlarged shaft portion 154 by rods 310.

As shown in FIG. 13, guiding members 302 and 304 overlap slightly circumferentially, with member 302 having a trailing edge finger 316 and member 304 having a trailing edge finger 318. The function of surfaces 306 and 308 and cam 314 is described hereinbelow.

The method of the invention will now be described in detail with reference to crimper 10. Continuous filament yarn 320 is fed from a spool of such yarn or other source of yarn supply through a conventional tension control mechanism 322 (FIG. 1) upwardly into slot 160 of cam 142. Slot 160 guides the yarn into the nip between feed rolls 38 and 40 with a traversing movement back and forth axially of the feed rolls.

In order to obtain uniform feeding of the yarn into the nip, both with respect to yarn quantity and orientation, it is necessary that tension of a controlled magnitude be applied to the yarn between mechanism 322 and feed rolls 38 and 40.

Also, a conventional preheater 325 may be interposed between mechanism 322 and cam 142 to preheat yarn 320 prior to the crimping thereof. Generally, it has been found desirable to preheat yarn which is heavier than two denier per filament. Preheating softens the yarn and facilitates the crimping thereof.

As the yarn passes through cam 142, it contacts rods 156 as shown in FIG. 11. Rods 156 are polished so that friction between the rods and the yarn is minimized. Should the yarn break within cam 142 and become wrapped around rods 156, it is much simpler to untangle the yarn from such rods than it is from around a continuous groove or shaft. In order to permit easy access to the interior of cam 142, flanges 148 and 150 have openings 324 and 326 therein, respectively.

Figure 2:
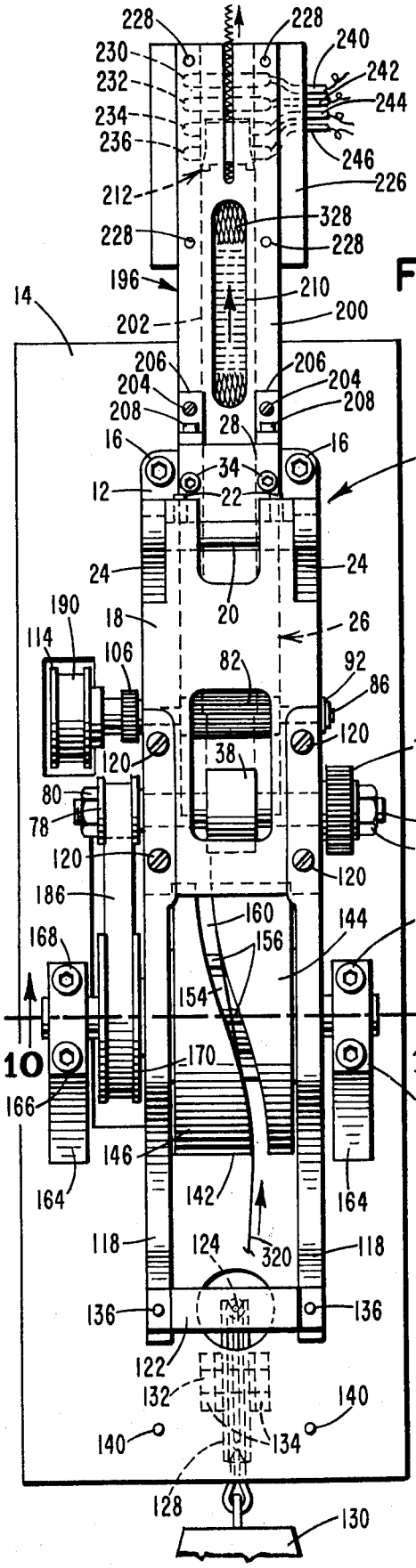
FIG. 2 is a front elevational view of the apparatus shown in FIG. 1.

As shown most clearly in FIG. 2, as slot 160 traverses yarn 320 back and forth axially of the feed rolls, the yarn is fed by the feed rolls into channel 36 in a substantially uniform manner back and forth across the cross-sectional dimension of the channel parallel to the axes of the feed rolls, i.e. the cross-sectional length of the channel.

If desired, the yarn feeding means comprising split cam 300 may be substituted for the feeding means comprising cam 142. As the yarn is fed through cam 300, it rides on elliptical cam 314 and is traversed back and forth axially of the feed rolls by guiding surfaces 306 and 308 in the same manner as it is traversed by slot 160 of cam 142. Elliptical cam 314 is designed such that the length of yarn between such cam and the nip between feed rolls 38 and 40 remains substantially constant. The portions of cam 314 along the long axis thereof engage the yarn as it is fed through the mid-portion of the feed rolls, and the portions of the cam along the short axis thereof engage the yarn as it is fed through the end portions of the feed rolls. This arrangement insures that the yarn will not become slack at any point as it is traversed axially of the feed rolls. Also, since guiding members 302 and 304 encompass only slightly greater than one half of the circumference of cam 300, access to the yarn in the feeding means is greatly facilitated.

Immediately after passage between the feed rolls, the yarn is fed against a mass of crimped yarn in the form of a core of crimped yarn 328 (FIG. 3) in the lower end of channel 36, causing the yarn to collapse longitudinally and fold over forming crimps which become part of the core. The generally elliptical transverse cross-sectional configuration of the lower portion of channel 36 minimizes voids in the channel in the zone immediately above the feed rolls so that a substantially uniform crimping pressure will be applied to the yarn after it passes between the feed rolls. The portion of channel 36 between feed rolls 38 and 40 and crimp control rolls 82 and 84 comprises a crimping zone in which the yarn initially is set. The crimp control rolls effectively isolate the crimping zone from the portion of channel 36 thereabove. By controlling the relative rotational velocities of the feed rolls and the crimp control rolls, the back pressure or crimping force exerted on the yarn may be accurately controlled. Generally, for a yarn of a particular denier, an increase in the crimping force results in a decrease in the leg length of the crimps and an increase in the bulk of the crimped yarn. The crimping force may be increased by decreasing the rotational velocity of crimp control rolls 82 and 84 with respect to the rotational velocity of feed rolls 38 and 40. The yarn is crimped and plastically deformed in the crimping zone. However, the heat and pressure applied to core 328 and the time of residence of the core in the crimping zone is insufficient to cause the yarn to be set permanently, and in the absence of pressure on the core the crimps will open freely after passage through the crimping zone. Moreover, for polyester yarn, it is desirable that the residence time of the yarn in the crimping zone be relatively short to minimize the effects of friction on the formation of the crimps, and therefore, the distance between feed rolls 38 and 40 and crimp control rolls 82 and 84 along channel 36 is relatively short. This arrangement facilitates accurate control of the conditions within the crimping zone, with the frictional forces exerted on the yarn by the walls of channel 36 in the crimping zone having little or no effect on such conditions.

Figure 18:
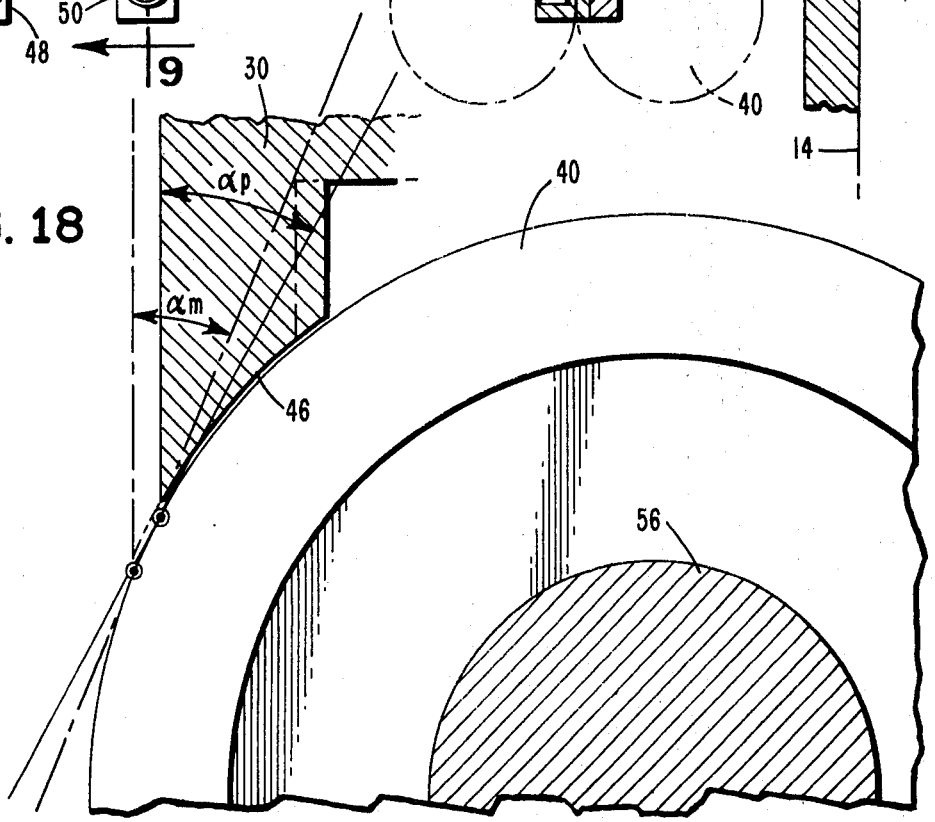
FIG. 18 is an enlarged sectional view of a portion of the apparatus shown in FIG. 1.

Also, desirably the cross-sectional dimension of channel 36 in the direction perpendicular to the axes of feed rolls 38 and 40, i.e. the cross-sectional width of the channel, should be as small as possible to promote uniform heat transfer from chamber 26 to and through core 328. Ideally, the cross-sectional width of channel 36 should be approximately equal to the diameter of yarn 320. However, at least two factors limit the minimum cross-sectional width of the channel. First, as the cross-sectional width of the channel is decreased, the angle defined between each of the side walls of the channel which extend in the direction parallel to the feed roll axes and respective arcuate surfaces 44 and 46 also is decreased (FIG. 18). If such angle is made too small, the adjacent portion of saddle 42 does not possess sufficient strength to withstand the pressure exerted thereagainst by core 328 without deforming or fracturing. Second, as such angle is decreased, the apex thereof necessarily is moved downwardly closer to the nip between feed rolls 38 and 40. If the apex of the angle is moved too close to the nip between the feed rolls, as yarn 320 is fed through the nip, the yarn will tend to move under surfaces 44 and 46 between such surfaces and feed rolls 38 and 40 rather than into channel 36. Due to these factors, it has been found that an angle $\alpha$ which is defined between the vertical projection of each of the side walls of the channel which extend in the direction parallel to the feed roll axes and a plane tangent to the adjacent feed roll must be at least approximately 23°, as shown in phantom lines in FIG. 18 and identified as angle $\alpha m$ (minimum $\alpha$). Angle $\alpha$ is substantially identical to the angle defined by such walls and surfaces 44 and 46. In the preferred embodiment of crimper 10, angle $\alpha$ is approximately 29°, as shown in solid lines in FIG. 18 and identified as angle $\alpha p$ (preferred $\alpha$).

Further, it has been found that the cross-sectional width of channel 36 in relation to the cross-sectional area of yarn 320 has an important effect on the operation of the crimper. For example, for wearing apparel yarn, i.e. 40–150 denier, the ratio of the cross-sectional width of the channel in inches to the yarn denier should be in the range of from about 0.000667 to about 0.00425; the cross-sectional area of the yarn being proportional to the denier thereof. Preferably, such ratio is in the range of from about 0.001 to about 0.004. If the cross-sectional width of channel 36 is reduced below an amount required to satisfy the above-mentioned range of values for such ratio, the yarn will tend to move under surfaces 44 and 46 between such surfaces and feed rolls 38 and 40. For yarn having a denier in the range of 40–150, the cross-sectional width of the channel should be in the range of from about 0.10 inch to about 0.17 inch, and preferably is about 0.16 inch.

Felt pads 52 prevent yarn 320 from moving out of the crimper between feed rolls 38 and 40 and arcuate surfaces 44 and 46, respectively, and particularly during start-up of the crimper before core 328 fills the crimping zone.

Crimp control rolls 82 and 84 feed core 328 upwardly out of the crimping zone and past such rolls into the portion of channel 36 above the crimp control rolls. The portion of channel 36 which extends between crimp control rolls 82 and 84 and the upper end of chamber 26 comprises a setting zone in which the core is subjected to heating and pressure only sufficient to keep the crimps formed in the crimping zone closed. The only pressure exerted on the core in the setting zone is the weight of the core itself and the relatively light weight of slug 212 which rides on the upper end thereof. In the setting zone, the yarn is fully set. Due to the relatively small amount of pressure exerted on the core in the setting zone, the frictional forces applied thereto in such zone are minimized. This is particularly important in the crimping of polyester yarn due to the undesirable effects which relatively large frictional forces have on the crimping of such yarn.

After passage through the setting zone, core 328 is fed into channel 202 of cooling tower 196 in which the yarn is cooled below the temperature at which it undergoes any molecular structural alteration in the absence of the application of a substantial force thereto. If desired, and depending upon the necessity therefore, a coolant, such as compressed air, may be introduced into and circulated through the core through openings 210.

The crimped yarn is withdrawn from channel 202 through channel 222 in slug 212 in continuous filament form by a conventional winder 330 on which it is wound into cones for further processing, as desired.

The external configuration and dimensions of slug 212 are important to smooth, substantially slub-free withdrawal of the yarn from cooling tower 196. The only portions of the slug which contact the upper end of core 328 are leg-like members 218 and 220 (FIG. 15). The portions of the core contacted by members 218 and 220 are positioned adjacent the short cross-sectional transverse dimension of channel 202 and are the portions in which the yarn feed direction, axially of the feed rolls, is reversed by cam 142 or split cam 300. Members 218 and 220 apply a slight pressure, namely the weight of slug 212, on such portions and thereby require that a relatively small increase in tension be applied to the yarn to pull it out from under the members. The application of this increased tension pulls substantially all of the tangles out of the yarn and thereby minimizes the occurrence of slubs. The central section of lower portion 216 does not contact core 328 so that there is no impedance to the withdrawal of yarn from the central portion of the core. Also the long external, transverse cross-sectional dimension of both upper portion 214 and lower portion 216 is less than the long transverse cross-sectional dimension of channel 202 so that slug 212 can rock back and forth slightly on members 218 and 220 to accommodate slight differences in the height of the end portions of the core.

As the yarn is withdrawn from tower 196, the upper end of core 328, and therefore slug 212, move vertically upwardly and downwardly as determined by the rate at which the yarn is withdrawn in relationship to the rate of upward movement of the core. Magnet 224 and reed switches 230, 232, 234 and 236 cooperate to control the height of the core.

Upper switch 230 and lower switch 236 are safety limit switches. When magnet 224 moves into proximity with upper switch 230 closing such switch, the driving means for crimper 10 (cam 142, feed rolls 38 and 40 and crimp control rolls 82 and 84) are deactivated. When the magnet moves into proximity with lower switch 236 closing such switch, the driving means for both crimper 10 and winder 330 are deactivated. These are both abnormal conditions and occur only under other than normal operating conditions, such as when the yarn breaks either between the crimper and winder or between the source of yarn supply and feed rolls 38 and 40.

During normal operating conditions, magnet 224 moves vertically upwardly and downwardly between switches 232 and 234; both of which are operably connected to the winder driving means. When magnet 224 moves into proximity with switch 232 closing such switch, winder 330 is driven at 100% of a predetermined speed. Such predetermined speed is slightly greater than the speed required to withdraw the yarn from tower 196 at the same rate at which it is fed into the tower. Therefore, the upper end of core 328 and slug 212 gradually move downwardly until magnet 224 moves into proximity with switch 234 closing such switch and permitting switch 232 to open. When switch 234 is closed, the winder is driven at a speed less than the aforementioned predetermined speed, for example, at 80% of the predetermined speed. At such lower speed the winder withdraws yarn at a rate slightly less than at which it is fed into tower 196. Thus, the upper end of the core and slug 212 move upwardly until magnet 224 again moves into proximity with switch 232 closing such switch and permitting switch 234 to open, again causing the winder to operate at 100% of the predetermined speed. In this manner, the upper end of the core and the slug move upwardly and downwardly continuously a distance approximately equal to the distance between switches 232 and 234, thus maintaining the upper end of the core within a predetermined range.

The foregoing method is particularly efficacious for crimping polyester yarn due to the substantial elimination of the effect of frictional forces on the core of crimped yarn as such core moves through crimper 10, and is advantageous for crimping other continuous filament yarns, such as nylon yarn.

While the foregoing constitutes a detailed description of a preferred embodiment of the method and apparatus of the invention, it is recognized that modifications thereof will occur to those skilled in the art. Accordingly, the scope of the invention is to be limited solely by the scope of the appended claims.

We claim:

1. A stuffer crimper for crimping continuous filament yarn having a denier in the range of approximately 40–150, said crimper comprising:

a housing;

a crimping chamber secured to said housing and having a channel extending therethrough, said channel having a generally rectangular transverse cross-section;

means for heating said chamber;

a pair of opposed feed rolls rotatably mounted on said housing adjacent one end of said chamber for feeding yarn into said chamber channel, the long cross-sectional dimension of said channel extending parallel to the rotational axes of said feed rolls and the short cross-sectional dimension of said channel extending perpendicular to said axes, the ratio of said short cross-sectional dimension in inches to the denier of said yarn having a minimum value of about 0.000667;

at least one crimp control roll rotatably mounted on said housing and extending into said chamber channel, the portion of said channel between the feed rolls and the crimp control roll defining a confined crimping zone, whereby continuous filament yarn is fed into said crimping zone by the feed rolls against a core of crimped yarn therein causing the yarn to collapse longitudinally and fold over forming crimps which become part of said core, the crimp control roll being spaced from the feed rolls along said channel a distance no greater than the distance required for the yarn to be plastically deformed and partially set in said crimping zone, the portion of said channel between the crimp control roll and the end of the chamber opposite the feed rolls defining a setting zone, whereby said core is fed into the setting zone by the crimp control roll and the yarn is fully set therein;

means for rotatably driving said pair of feed rolls at the same rotational velocity;

means for rotatably driving said crimp control roll independently of said feed rolls, whereby the pressure on the crimped yarn core in said crimping zone may be controlled by regulating the relative rotational velocities of the feed rolls and the crimp control roll;

a cooling tower affixed at one end thereof to said chamber at the end of the chamber opposite said feed rolls and having a channel extending therethrough aligned with said chamber channel, said tower channel defining a cooling zone, whereby the crimped yarn core is fed into said cooling zone after passage through said setting zone and the yarn is cooled therein;

means for withdrawing yarn from said tower channel and;

means for controlling the relative rotational velocity of said feed rolls and the withdrawal rate of said withdrawing means.

2. A stuffer crimper as recited in claim 1, wherein said controlling means is operable to control said withdrawal rate with respect to said feed roll velocity.

3. A stuffer crimper as recited in claim 1, wherein said controlling means comprises a plurality of magnetically sensitive switches spaced apart along said tower and operably connected to said feed roll driving means and said withdrawing means, and magnet means movable with an end of the crimped yarn core in the tower channel for selectively closing and opening said switches.

4. A stuffer crimper as recited in claim 1, wherein said controlling means comprises at least two magnetically sensitive switches spaced apart along said tower, said two switches being operably connected to said withdrawing means, and magnet means movable with an end of the crimped yarn core in the tower channel for selectively closing and opening said switches, whereby when one of said switches is closed and the other of said switches is open said withdrawal rate is a first predetermined magnitude and when said other switch is closed and said one switch is open said withdrawal rate is a second predetermined magnitude.

5. A stuffer crimper as recited in claim 4, wherein said controlling means comprises at least two additional magnetically sensitive switches, one of said additional switches being spaced apart along said tower above said two switches and the other of said additional switches being spaced apart along said tower below said two switches, said one additional switch being operably connected to said feed roll driving means and said other additional switch being operably connected to said feed roll driving means and said withdrawal means, whereby when said one additional switch is closed said feed roll driving means is turned off and when said other additional switch is closed said feed roll driving means and said withdrawing means are turned off.

6. A stuffer crimper for crimping continuous filament yarn having a denier in the range of approximately 40–150, said crimper comprising:

a housing;

a crimping chamber secured to said housing and having a channel extending therethrough, said channel having a generally rectangular transverse cross-section;

means for heating said chamber;

a pair of opposed feed rolls rotatably mounted on said housing adjacent one end of said chamber for feeding yarn into said chamber channel, the long cross-sectional dimension of said channel extending parallel to the rotational axes of said feed rolls and the short cross-sectional dimension of said channel extending perpendicular to said axes, the ratio of said short cross-sectional dimension in inches to the denier of said yarn having a minimum value of about 0.000667;

at least one crimp control roll rotatably mounted on said housing and extending into said chamber channel, the portion of said channel between the feed rolls and the crimp control roll defining a confined crimping zone, whereby continuous filament yarn is fed into said crimping zone by the feed rolls against a core of crimped yarn therein causing the yarn to collapse longitudinally and fold over forming crimps which become part of said core, the crimp control roll being spaced from the feed rolls along said channel a distance no greater than the distance required for the yarn to be plastically deformed and partially set in said crimping zone, the portion of said channel between the crimp control roll and the end of the chamber opposite the feed rolls defining a setting zone, whereby said core is fed into the setting zone by the crimp control roll and the yarn is fully set therein;

means for rotatably driving said pair of feed rolls at the same rotational velocity;

means for rotatably driving said crimp control roll independently of said feed rolls, whereby the pressure on the crimped yarn core in said crimping zone may be controlled by regulating the relative rotational velocities of the feed rolls and the crimp control roll;

a cooling tower affixed at one end thereof to said chamber at the end of the chamber opposite said feed rolls and having a channel extending therethrough aligned with said chamber channel, said tower channel defining a cooling zone, whereby the crimped yarn core is fed into said cooling zone after passage through said setting zone and the yarn is cooled therein;

means for withdrawing yarn from said tower channel; and a slug positioned freely in the end of said tower channel opposite the end of said tower affixed to said chamber and having a channel therethrough, said slug being adapted to ride on an end of the crimped yarn core in the tower channel, whereby the yarn is withdrawn through said slug channel in continuous filament form.

7. A stuffer crimper as recited in claim 6, wherein said slug comprises an upper generally parallelepiped shaped portion and a lower generally pyramidal shaped portion.

8. A stuffer crimper as recited in claim 7, wherein said lower slug portion includes a pair of leg-like members extending downwardly at respective opposite sides thereof, said members being the only portions of the slug adapted to contact said yarn core end.

9. A stuffer crimper as recited in claim 8, wherein said tower channel has a substantially rectangular transverse cross-section; and wherein said leg-like members are positioned adjacent the walls of said tower channel having the shortest transverse dimension.

10. A stuffer crimper as recited in claim 9, wherein the walls of said tower channel having the longest transverse dimension are substantially parallel to the axes of said feed rolls.

* * * * *